US008356780B2

(12) United States Patent
Tschinkel

(10) Patent No.: US 8,356,780 B2
(45) Date of Patent: Jan. 22, 2013

(54) FOOT BASE AND FOOT FOR AN APPLIANCE

(75) Inventor: Horst Tschinkel, Nuremberg (DE)

(73) Assignee: Electrolux Home Products Corporation N.V., Zaventem (BE)

( * ) Notice: Subject to any disclaimer, the term of this patent is extended or adjusted under 35 U.S.C. 154(b) by 487 days.

(21) Appl. No.: 12/089,717

(22) PCT Filed: Oct. 19, 2006

(86) PCT No.: PCT/EP2006/010062

§ 371 (c)(1),
(2), (4) Date: Apr. 10, 2008

(87) PCT Pub. No.: WO2007/045464

PCT Pub. Date: Apr. 26, 2007

(65) Prior Publication Data

US 2008/0251685 A1 Oct. 16, 2008

(30) Foreign Application Priority Data

Oct. 22, 2005 (EP) ..... 05023107

(51) Int. Cl.
*A47B 91/00* (2006.01)

(52) U.S. Cl. ..... 248/188.8; 248/188.1; 248/346.01

(58) Field of Classification Search ..... 248/188.8, 248/188.1, 346.01, 346.03, 346.04, 677, 248/188.3; 68/3 R, 235 R
See application file for complete search history.

(56) References Cited

U.S. PATENT DOCUMENTS

| | | | | |
|---|---|---|---|---|
| 7,717,380 | B2 * | 5/2010 | Kwon et al. | 248/188.3 |
| 7,744,049 | B2 * | 6/2010 | Kwon et al. | 248/188.3 |
| 2007/0262213 | A1 * | 11/2007 | de Toledo et al. | 248/188.8 |

FOREIGN PATENT DOCUMENTS

| | | |
|---|---|---|
| DE | 8505165 | 5/1985 |

* cited by examiner

*Primary Examiner* — Terrell McKinnon
*Assistant Examiner* — Todd M Epps
(74) *Attorney, Agent, or Firm* — Pearne & Gordon LLP

(57) ABSTRACT

The invention relates to a foot base (1) for an appliance, in particular for a washing machine, said foot base comprising: at least one supporting element (3), in particular a supporting plate; a sleeve element (13) protruding from said at least one supporting element (3); wherein said at least one supporting element (3) and/or said sleeve element (13) comprises a recess adapted to receive a shaft element, in particular a supporting stud or height-adjusting foot; and at least one locking element (15) connected to said at least one supporting element (3) and/or sleeve element (13) and adapted to lock said foot base (1) on a bottom element (40) of an appliance. A combination of a foot base and a shaft element as well as a home appliance having at least one foot base are also proposed.

19 Claims, 2 Drawing Sheets

Figure 5:
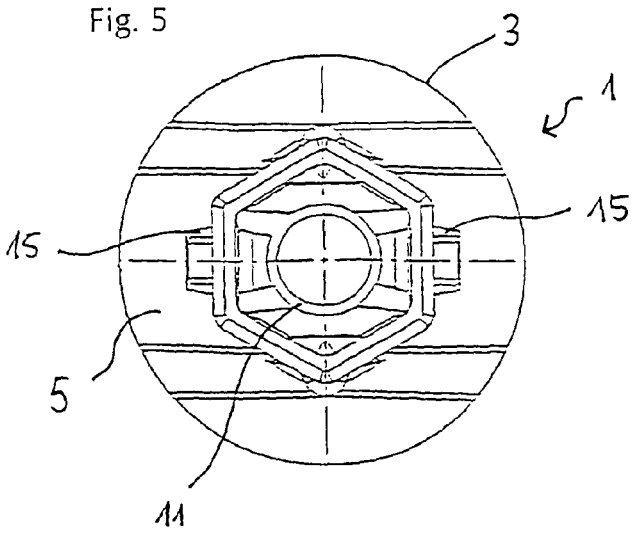

Fig. 1
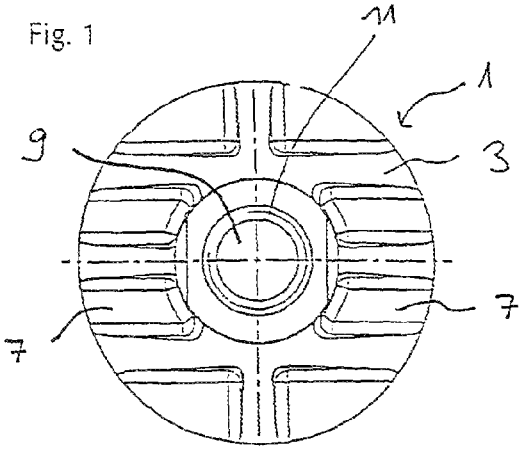
Fig. 3 (SECTION VIEW E-E)
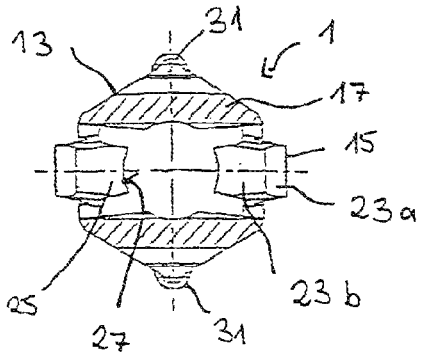
Fig. 2
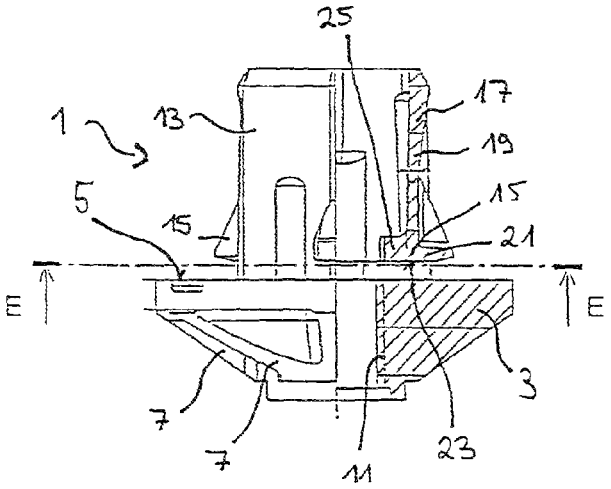
Fig. 4
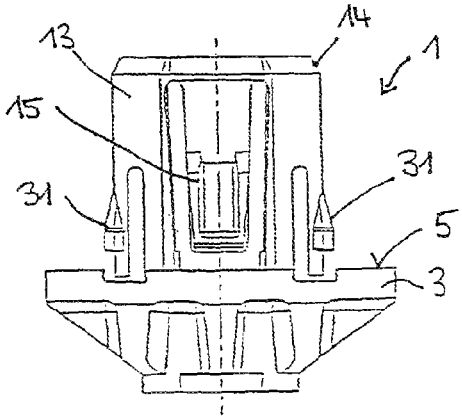

FOOT BASE AND FOOT FOR AN APPLIANCE

The present invention relates to a foot base for an appliance, in particular to a foot base for a washing machine, a foot arrangement comprising such a foot base, and an appliance having such a foot base or a foot arrangement.

A conventional height-adjustable screw-in foot base for a washing machine normally comprises a foot base to be inserted into a hole in a bottom plate of the washing machine, a counter nut and a threaded bolt to be screwed into the foot base in a height-adjustable manner. During mounting the foot base to the washing machine the foot base is inserted into the hole with a sleeve projecting through the hole to the inside of the washing machine. The sleeve has an external thread over which the counter nut is screwed to fix the foot base to the bottom plate of the washing machine. Then the threaded bolt is screwed into an internal thread of the foot base. Thus mounting the foot base to the washing machine requires several mounting steps including aligning the counter nut to the inserted threaded sleeve of the base plate, screwing the counter nut over the external thread of the sleeve and screwing down the counter nut with a pre-defined torque.

DE 85 05 165 U1 discloses a height adjustable foot base for household appliances with at least two locking elements, which are adapted to clamp the foot base against the inner edge of a recess of a bottom element in an appliance. The direction of the clamping force is in plain with the bearing surface of the foot base.

DE 35 13 641 A1 discloses a height adjustable foot base for furniture or household appliances. The arrangement of D2 requires a specifically formed insertion hole and an angular alignment of the foot base relative to the insertion hole for insertion and there after a turning step. The locking is generated by a fixed groove in the foot base.

It is an object of the present invention, to provide a foot base, a foot arrangement and an appliance having the same, which enable a significantly simplified mounting process for mounting the foot base to an appliance.

According, to claim 1 a foot base for an appliance is provided having at least one supporting element, in particular a supporting plate which is supportingly abutting against a mounting side or mounting element of the appliance, for example a bottom plate of the appliance. Normally the supporting element is fabricated from a plastic material and formed as a single part. However, depending on the structure of the supporting element other materials may be used and/or the supporting element can be comprised of several partial elements which for example are only connected by bridging elements which may be deflected. When a support element formed of several parts is used the casting process may be simplified and a stabilization of the individual part forming the final supporting element is achieved during the self-clamping effect when mounting the foot base (see below).

From the at least one supporting element a sleeve element is protruding. The at least one supporting element and/or the sleeve element comprise a recess (e.g. forming a hollow guiding, part of a hollow guiding or a passage) in which a shaft element may be inserted when mounting the foot base. In preferred embodiments the shaft element to be inserted into the recess or the passage is a supporting stud, a height-adjustable foot, a bolt or the like. The shaft element to be inserted may be used to fix the foot base on the bottom element of the appliance and/or the shaft element has itself the function of a foot, which, when being inserted into the foot base, serves as element on which the appliance stands. The sleeve element itself maybe comprised of a single element or of a plurality of elements, which are for example assigned to each one of the plurality of supporting elements. When being assembled at the appliance the sleeve elements or the plurality of sleeve elements form an inner surface of the recess or a partial surfaces of the recess where the inner surface of the recess is for example interrupted by gaps, recesses, clearances or the like.

At least one locking element is connected to or formed at that at least one supporting element and/or sleeve element. Preferentially two, three, four or more locking elements are provided at the foot base, symmetrically arranged relative to a hole in which the sleeve element is inserted for mounting the foot base. With the at least one locking element the foot base is fixed to a bottom element of an appliance, as mentioned above for example on a bottom plate of the appliance. In consequence, for mounting the foot base, the foot base is just inserted with its sleeve element section into a recess or hole in the bottom element of the appliance and the foot base is locked or clamped to the appliance by interaction of the locking element and the bottom element. Only one step is needed when mounting the foot base and after locking the foot base it is ready for insertion of the shaft element.

The at least one locking element has a clamping curvature or a cam which interacts with an abutting surface of the bottom element of an appliance such that a clamping gap decreases and/or a clamping force increases in dependency of a deflection distance or movement distance of the at least one locking element relative to the at least one supporting element. Preferentially the clamping curvature or cam is formed such that by a deflection first a clearance gap is closed and then with a further deflection a clamping force is increased.

In an embodiment the locking element themselves form the sleeve element or a portion of the sleeve element. For example if the locking elements protrude from the at least one supporting element such that the foot base is inserted into a hole of an appliance by guiding the locking elements through the hole.

According to a preferred embodiment the at least one locking element is designed such that when inserting the foot base into the bottom element of the appliance, the foot base is clamped at the bottom element without clearance. The clamping force prevents movement of the foot base relative to the bottom element and provides a stable mounting.

When one or at least one of the locking elements has a rear face adjoining to the inner surface of the recess, then a radially inward deflection of the at least one locking element is blocked after a shaft element has been inserted into the recess. Even if in use of the appliance (for example in a spinning washing machine) heavy vibrations develop, these cannot result in a slackening of the clamp of the at least one locking element at the bottom element.

Preferably, at least one of those locking elements has a rear section which protrudes into the recess of the shaft element. When the foot base has been mounted on the bottom element of the appliance and a shaft element is inserted, the locking element is deflected outward from the recess by the insertion of the shaft element, such that the locking or clamping force exerted by the locking element onto the bottom element is increased. Even under heavy movements or vibrations of the appliance the foot base is kept rigidly attached to the bottom element via the increased locking or clamping power. In such an arrangement the at least one locking element maybe provided with a clearance as related to clamping a bottom element section between the at least one locking element and the at least one supporting element when snapping the foot base into the bottom element. By the clearance available in the un-deflected state of the at least one locking element it is possible to overcome thickness tolerances of the bottom element section, which may be for example deviations from nominal curvature of the bottom plate of an appliance. These existing clearances which would allow relative movements between the snapped foot base and the bottom element are then removed by the deflection movement of the at least one locking element when inserting the shaft element into the recess. As mentioned above, the shaft element not necessarily has to protrude out of the recess and it is also possible to use the shaft element as a locking strengthener or stopper only.

In case the at least one locking element has a threaded section, e.g. forming part of an inner thread of the sleeve element, then the axial position of the at least one locking element is stabilized when a shaft element or bolt having an external thread is screwed into the recess of the sleeve element. In one embodiment a thread pitch distortion is provided at the external and/or internal thread of the recess, the at least one supporting element and/or the shaft element such that the torque necessary to turn the shaft element within the recess is high and prevents an unintentional rotation of the shaft element within the guiding. It is noted that the thread pitched distortion is not necessarily needed as for example the deflection of the rear section protruding into the recess in a force free state results into counter force acting onto the shaft element when the foot base has been mounted to the bottom element of the appliance.

Reference is made in detail to a preferred embodiment of the invention, an example of which is illustrated in the accompanying drawings which show:

FIG. 1 a bottom view of a foot base,

FIG. 2 a side view, partially in cross-section of the foot base of FIG. 1, FIG. 3 a cross section seen from below at the section line E-E shown in FIG. 2, FIG. 4 a side view of the foot base, FIG. 5 a top view of the foot base, FIG. 6 a side view, partially in cross-section of the foot base, and FIGS. 7A and 7B perspective views of the foot base.

FIG. 1 shows a bottom view of a foot base 1 having a base plate 3 and a stabilizing structure 7 for mechanically stabilizing the base plate 3 relative to an insertion sleeve 13 of the foot base 1. The base plate 3 has a bearing surface 5 which abuts against a bottom section of a household appliance (household appliance not shown but a bottom plate 14 is shown in FIG. 6 as an example of a bottom part of an appliance).

A threaded hole 9 is running through the base plate 3 and the stabilizing structure 7. The hole 9 is continued by an unthreaded hole running through the inserting sleeve 13. The threaded hole 9 has an internal thread 11, for example for screwing in a metric M8 stud bolt (not shown).

Figure 6:
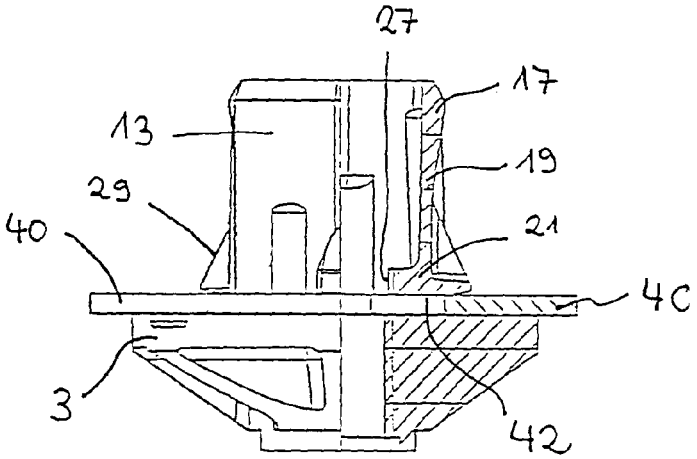
Figure 7A:
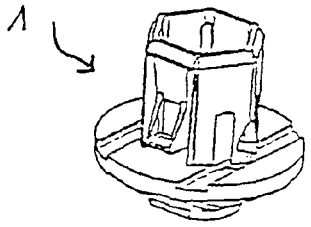
Figure 7B:
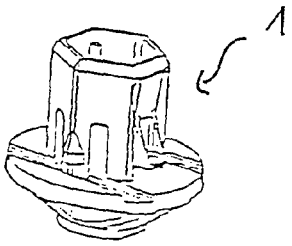

In cross-section (FIG. 3) the inserting sleeve 13 has approximately a hexagonal outer form and it has a tapered top 14 at its insertion end, to facilitate insertion of the inserting sleeve 13 into a hexagonal recess 42 of the bottom plate 14 shown in FIG. 6.

The side view in FIG. 2 shows the foot base 1 partially in its outer appearance (left side) and in cross-section (right side). Two detents 15 are formed at the inserting sleeve 13 wherein a lock head 21 of the detent 15 is connected by a cantilever 19 to an upper part of the sleeve wall 17 of the inserting sleeve 13. The cantilever 19 can be elastically deflected relative to the inserting sleeve 13 in an approximately radial direction, such that the lock head 21 can radially deflected inwards or outwards relative to the recess of the inserting sleeve 13. On its bottom face the lock head 21 has a curvature surface 23 which is formed of a first sloped portion 23*a* and a second flat portion 23*b* (as shown in FIG. 3).

An inner end 25 of the lock head 21 projects radially inwards from the base of the lower end of the cantilever 19. The surface facing to the recess of the inserting sleeve 13 is provided with an internal thread 27 (FIG. 3) which represents a continuation of the internal thread 11 in the base plate 3 and stabilizing structure 7.

When the foot base 1 is inserted into the hexagonal recess 42, alignment of the inserting sleeve 13 relative to the hexagonal recess 42 is simplified by the tapered top 14 and an alignment and preliminary fixing of the foot base 1 in the bottom plate 14 is provided by the auxiliary detents 31 (shown FIGS. 3 and 4) which act together with the detents 15. During the insertion movement, the detents 15 are deflected inwardly, wherein wedge-shaped guidance faces 29 (FIG. 6) abut against the inner edge of the hexagonal recess 42. During the insertion the detents 15 are increasingly deflected inward by the wedge-shaped guidance face 29 until the top of the guidance face 29 is reached. Beyond this point, the detents 15 deflect outward as long as there is a clearance between an inner edge of the hexagonal recess 42 and the curvature surface 23 at the bottom of the detents 15. The distance between the deepest point of the curvature surface 23 and the level of the bearing surface 5 is such, that the gap is somewhat smaller than the thickness of the bottom plate 15 in an un-deflected state of the detents 15 (un-deflected state of the cantilever 19) as shown for example in FIG. 2. In consequence, the inner end 25 or the internal thread 27 of the detents 15 are inwardly offset relative to the internal thread 11 of the base plate 3. At this point this sloped portion 23*a* of the curvature surface 23 abuts against the inner edge of the hexagonal recess 42. When now a threaded bolt of a foot to be inserted into the foot base 1 is screwed into the foot base from below, the threaded bolt pushes the detents 15 apart of each other (radially outward) so that the flat portion 23*b* of the curvature surface 23 is pressed against the edge of the recess 42 and the surrounding surface adjacent to the recess edge. Thereby a clamping force is exerted between the lock head 21 and the bearing surface 5 of the base plate 3 thereby clamping the bottom plate 40.

Of course, the form of the recess 42 or hole for inserting the inserting sleeve 13 may have any form, for example circular, square or the like. Correspondingly, the outer form of the inserting sleeve 13 maybe of any form such that the inserting sleeve 13 fits into the recess or hole. Further, the form of the curvature surface 23 of the lock head 21 may have any form which results in the decrease of the distance between the lower end of the curvature surface 23 and the bearing surface 5. For example the surface 23 maybe bend in an arc, wherein the center of the arc deviates from the center of deflection when the lock head 21 is deflected outward by bending the cantilever 19 around its 'fictitious' pivoting point.

In an embodiment not shown the detents protrude upwardly from the base plate 3 and cantilevers (like 19) connect a lock head of the detents to the base plate. The lock heads are tapered from the base plate-side to the tip. In this embodiment the sleeve 13 is omitted and the detents represent the sleeve to be inserted into the recess 42. When the foot base of this embodiment is inserted into the recess, the cantilevers pass through the plate 40, having a length of the thickness of the plate 40 or approximately the thickness. The cross-section of the recess or guiding formed by the detents tapers from below (from the base plate 3 to the tip of the detents). When a bolt or threaded bolt (supporting stud) is now inserted into the recess of the foot base, the detents are again radially deflected and press against the plate 40.

REFERENCE NUMERAL LIST

1 foot base
3 base plate

5 bearing surface
7 stabilizing structure
9 threaded hole
11 internal thread
13 inserting sleeve
14 tapered top
15 detent
17 sleeve wall
19 cantilever
21 lock head
23 curvature surface
23*a* sloped portion
23*b* flat portion
25 inner end
27 internal thread
29 wedge-shaped guidance face
31 auxiliary detent
40 bottom plate
42 hexagonal recess

The invention claimed is:

1. Foot base for an appliance, in particular for a washing machine, comprising:

at least one supporting element comprising a bearing surface;

a sleeve element protruding from said at least one supporting element;

wherein at least one of said supporting element and said sleeve element comprises a recess adapted to receive a shaft element;

at least one locking element connected to said at least one of the supporting element and the sleeve element and adapted to lock said foot base on a bottom element of an appliance, the at least one locking element having a clamping surface; and a gap provided between the clamping surface and the bearing surface, wherein as the shaft element is inserted into the recess, the clamping surface is pressed against an edge of the recess so that a clamping force is applied substantially perpendicular to the bearing surface, and wherein as the clamping force increases and the locking element is displaced outwardly from the recess, the gap between the clamping surface and the bearing surface decreases to clamp the bottom plate between the clamping surface and the bearing surface.

2. Foot base according to claim 1, wherein at least one of said locking elements (15) has a rear surface (27) adjoining to said recess or forming part of said recess.

3. Foot base according to claim 1, wherein at least one of said locking elements (15) has a rear section (25) and/or rear surface (27) protruding into said recess.

4. Foot base according to claim 3, wherein said protruding rear section (25) or rear surface (27) and a shaft element to be inserted into said recess form an actuating means adapted to displace said at least one locking element (15) when inserting the shaft element into said recess, in particular an actuating means adapted to radially or approximately radially displace said at least one locking element (15).

5. Foot base according to claim 3, wherein said protruding rear surface (27) or rear section (25) has an internal thread or internal thread section forming part of said recess.

6. Foot base according to claim 1, wherein said at least one locking element (15) is movably or pivotally connected to said at least one supporting element (3) and/or sleeve element (13).

7. Foot base according to claim 1, wherein said at least one sleeve element (13) is perpendicularly protruding to a supporting surface (5) of said at least one supporting element (3).

8. Foot base according to claim 1, wherein said at least one supporting element (3) and/or said sleeve element (13) has an internal thread (11) or at least a section of an internal thread.

9. Appliance, in particular washing machine, having at least one foot base (1) or foot arrangement according to claim 8.

10. Foot base according to claim 1, wherein said at least one locking element (15) is a detent.

11. Foot base according to claim 1, wherein at least two locking elements (15) are provided.

12. Foot base according to claim 1 wherein the sleeve element of portions of the sleeve element are formed by at least two locking elements.

13. Foot arrangement comprising a foot base (1) according to claim 1 and a shaft element, in particular a supporting stud or height-adjusting foot, adapted to be inserted into said sleeve element (13) and/or into said at least one supporting plate (3) of said foot base (1).

14. Foot arrangement according to claim 13, wherein said shaft has an external thread.

15. Foot base (1) or foot arrangement according to claim 1, wherein said external thread (11, 27) has a thread pitch distortion.

16. Foot arrangement according to claim 13, wherein said height-adjusting foot is a screw-in foot.

17. Foot arrangement according to claim 13, wherein said supporting stud or height-adjusting foot comprises a foot plate or foot section.

18. Foot base (1) for an appliance, in particular for a washing machine, comprising:

at least one supporting element (3) comprising a bearing surface (5);

a sleeve element (13) protruding from said at least one supporting element (3);

wherein at least one of said supporting element (3) and said sleeve element (13) comprises a recess adapted to receive a shaft element;

at least one locking element (15) connected to said at least one of the supporting element (3) and the sleeve element (13) and adapted to lock said foot base (1) on a bottom element (40) of an appliance;

wherein said at least one locking element (15) has a clamping surface (23) or cam comprising a flat portion (23*b*) that is generally parallel to said bearing surface (5) and a sloped portion (23*a*) arranged at an angle relative to said flat portion (23*b*); and wherein said sloped portion (23*a*) is configured to engage said bottom element (40) of an appliance until said at least one locking element (15) is displaced outwardly from said recess, whereupon said bottom element (40) is then clamped between said flat portion (23*b*) and said bearing surface (5) via a clamping force that is applied substantially perpendicular to said bearing surface (5).

19. Foot base for an appliance, in particular for a washing machine, comprising:

at least one supporting element comprising a bearing surface;

a sleeve element protruding from said at least one supporting element;

wherein at least one of said supporting element and said sleeve element comprises a recess adapted to receive a shaft element;

and at least one locking element connected to said at least one of the supporting element and the sleeve element and adapted to lock said foot base on an opening formed in a bottom element of an appliance, the at least one locking element having a clamping surface that comprises a flat portion which is spaced apart from and parallel to said bearing surface, the flat portion being pressed against an upper surface of a bottom plate surrounding an edge of said opening when the shaft element is received into said recess such that said bottom plate is then clamped between said flat portion and said bearing surface via a clamping force that is applied substantially perpendicular to said bearing surface.

* * * * *

UNITED STATES PATENT AND TRADEMARK OFFICE

CERTIFICATE OF CORRECTION

PATENT NO. : 8,356,780 B2
APPLICATION NO. : 12/089717
DATED : January 22, 2013
INVENTOR(S) : Horst Tschinkel It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 592 days.

Signed and Sealed this
First Day of September, 2015

Michelle K. Lee

Michelle K. Lee
*Director of the United States Patent and Trademark Office*